US009991073B2

(12) United States Patent
Kralik

(10) Patent No.: US 9,991,073 B2
(45) Date of Patent: Jun. 5, 2018

(54) SWITCHING DEVICE WITH PERMANENT-MAGNETIC ARC EXTINGUISHMENT

(71) Applicant: Schaltbau GmbH, Munich (DE)

(72) Inventor: Robert Kralik, Poing (DE)

(73) Assignee: Schaltbau GmbH, Munich (DE)

( * ) Notice: Subject to any disclaimer, the term of this patent is extended or adjusted under 35 U.S.C. 154(b) by 0 days. days.

(21) Appl. No.: 15/003,766

(22) Filed: Jan. 21, 2016

(65) Prior Publication Data

US 2016/0217951 A1 Jul. 28, 2016

(30) Foreign Application Priority Data

Jan. 22, 2015 (DE) ..... 10 2015 000 796

(51) Int. Cl.
*H01H 33/18* (2006.01)
*H01H 9/34* (2006.01)
(Continued)

(52) U.S. Cl.
CPC ..... *H01H 33/182* (2013.01); *H01H 9/346* (2013.01); *H01H 9/443* (2013.01);
(Continued)

(58) Field of Classification Search
CPC ..... H01H 33/08; H01H 33/18; H01H 33/182; H01H 9/346; H01H 9/443; H01H 1/20; H01H 50/546
(Continued)

(56) References Cited

U.S. PATENT DOCUMENTS 3,575,635 A 4/1971 Maggi
4,367,448 A * 1/1983 Nishizako ..... H01H 9/443 335/201
(Continued)

FOREIGN PATENT DOCUMENTS

DE 2851560 A1 5/1980
DE 69701902 T2 12/2000
(Continued)

OTHER PUBLICATIONS

Office Action, dated May 1, 2017, for related Korean Application No. KR10-2016-0007793, with English translation, 10 pages.
(Continued)

*Primary Examiner* — Renee Luebke
*Assistant Examiner* — William Bolton
(74) *Attorney, Agent, or Firm* — Kilpatrick Townsend & Stockton LLP

(57) ABSTRACT

The present invention relates to a switching device with at least one contact point and an arc blow device associated with the contact point, where the arc blow device comprises at least one blow magnet for generating a magnetic blow field, and where the blow field is of such nature that a switch arc developing when the contact point opens is blown out from the contact point. It is according to the invention provided that the blow field comprises a first magnetic field area and a second magnetic field area arranged adjacent to the first magnetic field area, where the magnetic field lines of the first magnetic field area are oriented in opposite direction to the magnetic field lines of the second magnetic field area, and where the blow field further comprises a transition area which connects the first magnetic field area and the second magnetic field area with each other, where the orientation of the magnetic field lines in the transition area, each starting out from the first magnetic field area and
(Continued)

Figure 1:
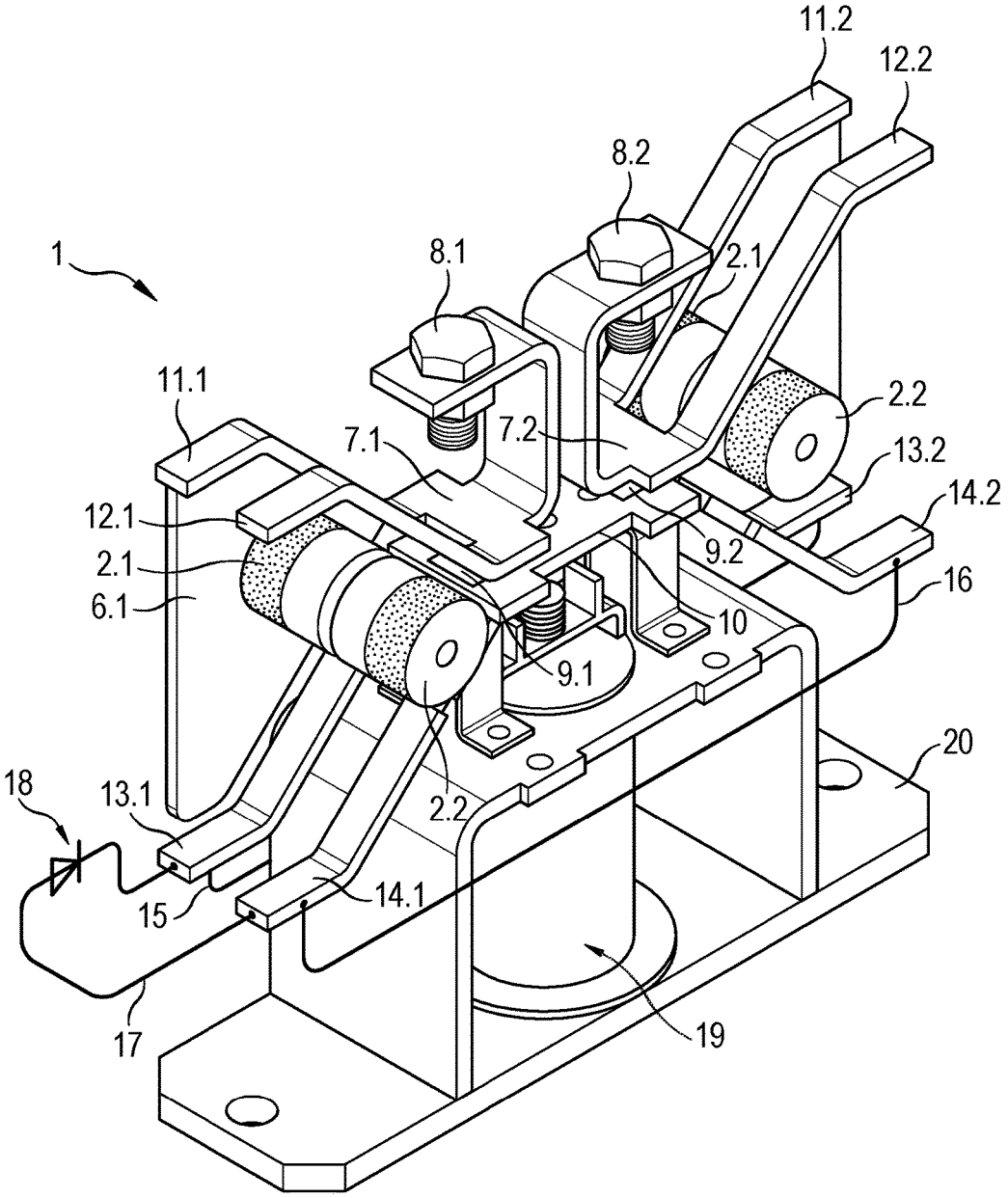

the second magnetic field area, aligns toward the contact point so that the switch arc within the transition area is in dependence of the direction of the current, starting out from the contact point, directed either into the first magnetic field area or into the second magnetic field area and there in both cases blown in the same direction away from the contact point.

11 Claims, 9 Drawing Sheets

(51) Int. Cl.

| | |
|---|---|
| ***H01H 9/44*** | (2006.01) |
| ***H01H 9/46*** | (2006.01) |
| ***H01H 33/08*** | (2006.01) |
| ***H01H 1/20*** | (2006.01) |
| ***H01H 50/54*** | (2006.01) |

(52) U.S. Cl.
CPC ..... *H01H 9/46* (2013.01); *H01H 33/08* (2013.01); *H01H 1/20* (2013.01); *H01H 50/546* (2013.01)

(58) Field of Classification Search
USPC ..... 218/23, 26, 40, 31; 335/202, 201
See application file for complete search history.

(56) References Cited

U.S. PATENT DOCUMENTS

| | | | | |
|---|---|---|---|---|
| 4,743,720 | A | 5/1988 | Takeuchi et al. | |
| 5,138,122 | A | 8/1992 | Moldovan et al. | |
| 5,818,003 | A | 10/1998 | Moldovan et al. | |
| 7,417,520 | B2 * | 8/2008 | Kralik | H01H 9/34 335/201 |
| 8,222,983 | B2 * | 7/2012 | Zhou | H01H 9/443 335/201 |
| 2009/0127229 | A1 * | 5/2009 | Schmitz | H01H 9/443 218/22 |
| 2012/0145675 | A1 | 6/2012 | Zhou et al. | |
| 2013/0075367 | A1 * | 3/2013 | Eriksson | H01H 9/40 218/34 |
| 2013/0264310 | A1 * | 10/2013 | Lang | H01H 1/20 218/2 |
| 2013/0264311 | A1 | 10/2013 | Lang et al. | |
| 2013/0313228 | A1 * | 11/2013 | Friedrichsen | H01H 1/20 218/23 |
| 2014/0151338 | A1 | 6/2014 | Gerving et al. | |
| 2014/0166620 | A1 | 6/2014 | Gerving et al. | |
| 2014/0360982 | A1 | 12/2014 | Gerving et al. | |

FOREIGN PATENT DOCUMENTS

| | | | | |
|---|---|---|---|---|
| EP | 2463880 | A1 | 6/2012 | |
| EP | 2605265 | A1 * | 6/2013 | H01H 73/18 |
| EP | 2608236 | A1 | 6/2013 | |
| FR | 2 441 915 | A1 | 6/1980 | |
| KR | 10-2013-0044319 | | 5/2013 | |

OTHER PUBLICATIONS

Office Action, dated Oct. 12, 2016, for corresponding Ukrainian patent application No. UA20160000468, English translation, 3 pages.

European Search Report, dated Jun. 28, 2016, for related European Application No. EP 16 00 0145, 5 pages.

* cited by examiner

SWITCHING DEVICE WITH PERMANENT-MAGNETIC ARC EXTINGUISHMENT

This application claims priority to German Patent Application No. 102015000796.3, filed Jan. 22, 2015, the disclosure of which is incorporated by reference herein.

The present invention relates to a switching device according to the preamble of independent claim 1.

A generic switching device comprises at least one contact point and an arc blow device associated with the contact point. The arc blow device comprises at least one blow magnet for generating a magnetic blow field. The blow field is of such nature that a switch arc developing when the contact point opens is blown out from the contact point.

A generic switching device is known, for example, from EP 2230678 A2. This is an arc-resistant contactor whose arc blow device comprises both permanent magnets as well as electrically operated blow-out coils. The use of blow-out coils for g a magnetic blow field usually means that the switching device is relatively heavy, large and also expensive to manufacture. In addition, the blow effect on the arc depends on the current intensity, which gives rise to critical current ranges. Activating the blow-out coils in the instant of switching requires additional expenses.

The object of the present invention is to provide a switching device of this generic type which ensures reliable extinguishment of the arc regardless of the direction of the current, while having a simple and inexpensive configuration.

The object is satisfied by the features of independent claim 1. According thereto, a solution according to the invention for a generic switching device is given when the blow field comprises a first magnetic field area and a second magnetic field area arranged adjacent to the first magnetic field area, where the magnetic field lines of the first magnetic field area are oriented in opposite direction to the magnetic field lines of the second magnetic field area, and where the blow field further comprises a transition area which connects the first magnetic field area and the second magnetic field area with each other, where the orientation of the magnetic field lines in the transition area, each starting out from the first magnetic field area and the second magnetic field area, aligns toward the contact point so that the switch arc within the transition area is in dependence of the direction of the current, starting out from the contact point, directed either into the first magnetic field area or into the second magnetic field area and there in both cases blown in the same direction away from the contact point.

The solution according to the invention offers the advantage that the switch arc is always blown in the same direction out from the casing of the switching device irrespective of the direction of the current, so that only one arc extinguishing device is needed to extinguish the switch arc. The magnetic blow field can there be created purely permanent-magnetically, so that the use of heavy and expensive blow-out coils can be completely dispensed with. The switching device according to the invention is therefore very compact. The switch arc therefore develops in the center of the transition area of the blow field and is therefore directed either into the first magnetic field area or into the second magnetic field area, depending on the direction of the current. The magnetic field lines are in the transition area preferably fanned out over an angle of 180°. A particularly simple configuration is obtained when the second magnetic field area is formed in mirror image to the first magnetic field area.

Advantageous embodiments of the present invention are the subject matter of the dependent claims.

In one preferred embodiment of the present invention, the first magnetic field area is associated with a first channel and the second magnetic field area with a second channel, where the first channel and the second channel extend parallel and are arranged adjacently, and where the first channel is transverse to its longitudinal extension permeated by the magnetic field lines of the first magnetic field area, and the second channel is transverse to its longitudinal extension permeated by the magnetic field lines of the second magnetic field area.

Due to the provision of the channels, the switch arc can be securely and reliably directed away from the contact point.

In a further preferred embodiment of the present invention, the switching device further comprises an arc extinguishing device which is arranged such that the switch arc is blown through the arc blow device into the arc extinguishing device, irrespective of the direction of the current. Reliable extinguishment of the arc is thus achieved in a cost-effective manner.

In a further particularly preferred embodiment of the present invention, the arc blow device comprises a first lateral pole plate, a second lateral pole plate and an interposed center pole plate, where the first magnetic field area is given between the first lateral pole plate and the center pole plate, and where the second magnetic field area is given between the second lateral pole plate and the center pole plate. In this embodiment, the blow field can be created precisely and in a simple manner. Furthermore, this embodiment enables a particularly compact and structurally favorable solution. In the first magnetic field area and in the second magnetic field area, the magnetic field lines extend substantially perpendicular to the pole plates. The aforementioned channels each extend between a lateral pole plate and the center pole plate. The pole plates preferably form the side walls of the channels.

In a further particularly preferred embodiment of the present invention, the first lateral pole plate is associated with at least one first blow magnet, and the second lateral pole plate with at least one second blow magnet, where the first blow magnet and the second blow magnet are poled oppositely. The first blow magnet and the second blow magnet are each preferably arranged between a lateral pole plate and the center pole plate. Furthermore, the first blow magnet in preferably in direct contact with the first lateral pole plate, the second blow magnet is preferably in direct contact with the second lateral pole plate.

In another also particularly preferred embodiment of the present invention, the center pole plate at least at one first end facing the contact point is shorter than the two lateral pole plates. Particularly advantageous fanning out of the magnetic field lines in the transition area is thereby achieved. It is there particularly advantageous to have the two lateral pole plates extend laterally adjacent to the contact point, so that the contact point is located between a first end of the first lateral pole plate and a first end of the second lateral pole plate. It is in this manner ensured that the switch arc is after its formation reliably directed in dependence of the direction of the current either into the first magnetic field area or into the second magnetic field area. Further preferably, the center pole plate is at a second end, being disposed opposite to its first end, also shorter than the two lateral pole plates. The switch arc is thereby prior to entering into the arc extinguishing device again directed toward the center, so to speak, in the plane of symmetry of the center pole plate. The arc extinguishing device can thereby be designed to be particularly compact.

In another particularly preferred embodiment of the present invention, the contact point comprises a fixed contact and a movable contact, where a first arc guide plate and a second arc guide plate are associated with the fixed contact, where the first arc guide plate and the second arc guide plate each extend between the contact point and the arc extinguishing device and are conductively connected to the fixed contact, where a third arc guide plate and a fourth arc guide plate are associated the movable contact point, where the third arc guide plate and the fourth arc guide plate also each extend between the contact point and the arc extinguishing device, and where the third arc guide plate and the fourth arc guide plate are each spaced from the movable contact and where the first arc guide plate and the third arc guide plate form a first pair of arc guide plates associated with the first magnetic field area and the second arc guide plate and the fourth arc guide plate form a second pair of arc guide plates associated with the second magnetic field area, and where the arc guide plates of the first and the second pair, starting out from the contact point, each diverge such that the switch arc is stretched either between the first arc guide plate and the third arc guide plate or between the second arc guide plate and the fourth arc guide plate when the switch arc is blown through the arc blow device into the arc extinguishing device. Extinguishing the switch arc is in this embodiment considerably simplified by it being stretched. The third and the fourth arc guide plate are not connected to the movable contact. They can therefore in a simple manner be attached to a stationary component of the switching device. The mass which is connected to the movable contact and which therefore needs to be accelerated when closing or opening the contact point is therefore very small. The drive of the movable contact can accordingly be of small dimension. In order for the switch arc to be able to spark over from the movable contact to the third or fourth arc guide plate, it is advantageous if only a small gap exists between the third or the fourth arc guide plate, respectively, and the movable contact. The first and the second arc guide plate, however, are preferably fixedly connected to the fixed contact, and are further preferably formed integrally with the fixed contact. In this manner, only few components have to be manufactured and installed. The structure of the switching device thereby remains simple and inexpensive.

In a further particularly preferred embodiment of the present invention, the switching device comprises a first contact point and a second contact point, where the movable contacts of the first and the second contact point are arranged on a common contact bridge, and where the third arc guide plate and the fourth arc guide plate at the first contact point are electrically connected to the third arc guide plate and the fourth arc guide plate at the second contact point. It is in this embodiment ensured in a simple manner that the switch arc sparks over onto the arc guide plates and is directed and thereby stretched between the respectively affected arc guide plates on the way into the associated arc extinguishing device.

It is particularly preferably provided that the third arc guide plate at the first contact point is by a first electrically conductive connection electrically conductively connected to the third or the fourth arc guide plate at the second contact point, where the fourth arc guide plate at the first contact point is by a second electrically conductive connection electrically conductively connected to the respective other third or fourth arc guide plate at the second contact point, where a third electrically conductive connection exists between the first electrically conductive connection and the second electrically conductive connection, and where a diode permitting only one direction of current is preferably provided in the third electrically conductive connection. In this embodiment, the switching device according to the invention is suitable not only for DC operation but also for AC operation. Even if AC voltage is applied to the switching device, the switch arc is reliably extinguished. If the switch arc develops at the first contact point, for example, during a positive half-wave, then it is with the respective polarity directed into the first magnetic field area, where the current there flows inter alia via the switch arc at the first contact point, the diode and the switch arc at the second contact point. After completion of the positive half-wave, any current can no longer flow since the diode prevents a current flow in the opposite direction. Re-solidification occurs, the switch arc collapses. The third electrically conductive connection can be formed at any point between the first and the second electrically conductive connection. For example, it is possible to provide the third electrically conductive connection between the third and the fourth arc guide plate at the first contact point. The configuration effort is particularly low when the third and the fourth arc guide plates at the first and the second contact point are connected to each other in parallel. This means that the third arc guide plate at the first contact point is electrically conductively connected to the oppositely disposed third arc guide plate at the second contact point, and the fourth arc guide plate at the first contact point is electrically conductively connected to the oppositely disposed fourth arc guide plate at the second contact point. The third and the fourth arc guide plates can, with the polarity of the magnetic blow field changed accordingly, be connected at the two contact points but also crosswise to each other.

In a further preferred embodiment of the present invention, the switching device comprises a first contact point and an adjacently disposed second contact point, where the center pole plate at the first contact point and the center pole plate at the second contact point are of different magnetic polarities. The blow fields at the two contact points are thereby optimized. The center pole plate at the first contact point is there preferably aligned flush with the center pole plate of the second contact point.

In a further particularly preferred embodiment of the present invention, the one or more blow magnets are exclusively permanent magnets. This switching device of the invention is thereby particularly simple in structure and inexpensive to manufacture. The compact design can be further optimized if the permanent magnets are rare earth magnets.

According to a further particularly preferred embodiment of the present invention, the switching device comprises a first contact point and a second contact point, where the first contact point is associated with a first arc blow device and the second contact point with a second arc blow device, where the first contact point comprises a first fixed contact and a first moveable contact, where the second contact point comprises a second fixed contact and a second movable contact, where the first movable contact and the second movable contact are arranged at oppositely disposed ends of a common contact bridge, where the first fixed contact is associated with at least one first arc guide plate and the second fixed contact at least one second arc guide plate, where the first arc guide plate and the second arc guide plate extend between the respective fixed contact and the arc extinguishing device and are conductively connected to the respective fixed contact, where furthermore a third arc guide plate and a fourth arc guide plate are provided, where the third arc guide plate and the fourth arc guide plate each extend in an arcuate manner from the first movable contact to the second movable contact, so that the third arc guide plate and the fourth arc guide plate together with the contact bridge each form an almost closed loop, and where the center pole plates of the first and the second arc blow device are each arranged between the third and the fourth arc guide plate.

This embodiment is particularly simple in structure and can therefore be produced inexpensively. This embodiment at the same time leads to a particularly high extinguishing potential, both in DC operation as well as in AC operation. The first arc blow device and the second arc blow device are essentially configured in mirror symmetry to each other. The magnetic polarity of the pole plates of the first arc blow device in this embodiment therefore matches the magnetic polarity of the pole plates of the second arc blow device. The ends of the third and the fourth arc guide plate are each slightly spaced from the ends of the contact bridge so that the contact bridge can be moved relative to the third and the fourth arc guide plate. A foot of the arc sparks over from the contact bridge onto the third or the fourth arc guide plate, respectively, when the arc is blown out from the contact point. A particularly advantageous configuration is obtained when the contact bridge is arranged above the fixed contacts. The first arc guide plate and the second arc guide plate are preferably disposed below the respective center pole plate and each extend in width over both the first channel as well as over the parallel second channel of the associated arc blow device. They each preferably connect the fixed contact with the associated terminal contact. The corners of the contact bridge are preferably rounded in order to increase service life.

According to a particularly preferred embodiment, the first blow magnet of the first arc blow device and the first blow magnet of the second arc blow device are disposed within the loop being formed by the third arc guide plate and the contact bridge, where the second blow magnet of the first arc blow device and the second blow magnet of the second arc blow device are disposed within the loop being formed by the fourth arc guide plate and the contact bridge. The blow magnets are thereby in a simple manner shielded from the arc. A protective covering for the blow magnets made of ceramic or the like is not required.

In a further preferred embodiment, the center pole plates of the first and the second arc blow device are sheathed in an electrically insulating manner. The sheath can be made of suitable plastic or ceramic.

According to a further preferred development of this embodiment, the arc extinguishing device comprises a first arc extinguishing device and a second arc extinguishing device, where the first and the second arc extinguishing device are arranged on oppositely disposed sides of a casing of the switching device such that the first channel and the second channel of the first arc blow device lead to the first arc extinguishing device, where the first and the second channel of the second arc blow device lead to the second arc extinguishing device. Particular preferably, a third arc extinguishing device is further disposed on an upper side of the casing connecting the two oppositely disposed sides such that the first and the second channels of the first and the second arc blow devices also lead to the third arc extinguishing device. As a result, the extinguishing potential can be further increased if required. Parts of the casing being located between the arc extinguishing device can by suitable copper plates be protected from the arc as needed It is further advantageous if the arc extinguishing device can, possibly together with the two arc blow devices, for maintenance purposes be completely removed from the casing of the switching device to allow for unobstructed access in a simple manner to the fixed contacts and the contact bridge. The drive of the switching device is advantageously located below the two fixed contacts.

According to an advantageous embodiment, the arc extinguishing devices each comprise a plurality of extinguishing elements that are stacked. The extinguishing elements can be made of ceramic. The extinguishing elements at that end which faces the contact point or the third and the fourth arc guide plate, respectively, each comprise at least two wedge-shaped flanks, where the wedge-shaped flanks of each extinguishing element complement the wedge-shaped flanks of each subsequent extinguishing element to form two V-shaped grooves which are each associated with one of the two channels. Depending on the direction of the current, the arc is blown either through the first channel or through the second channel of the respective arc blow device into one of the two V-shaped grooves. The arc extinguishing devices each comprise a plurality of openings toward the outside, so that the plasma that is created by the switch arc can escape from the casing of the switching device. The openings are preferably formed by respective grooves in the extinguishing elements The switching capacity can be further increased if the contact bridge is according to a further preferred embodiment arranged on a contact carrier made of electrically insulating material, where the contact carrier extends between the first contact point and the second contact point across the clear width of the casing of the switching device. The contact carrier very preferably plunges on both sides into corresponding grooves of the housing such that a barrier in the fashion of a labyrinth seal is formed for the plasma created by the arc. A bellows can further be disposed below the contact carrier to prevent a ground fault which would otherwise occur due to the plasma created by the arc in the event of a flash-arc onto the yoke plate of the drive of the switching device when respective high loads are switched.

The switching device is very preferably a contactor.

The present invention further provides an arc blow device for a switching device.

Figure 2:
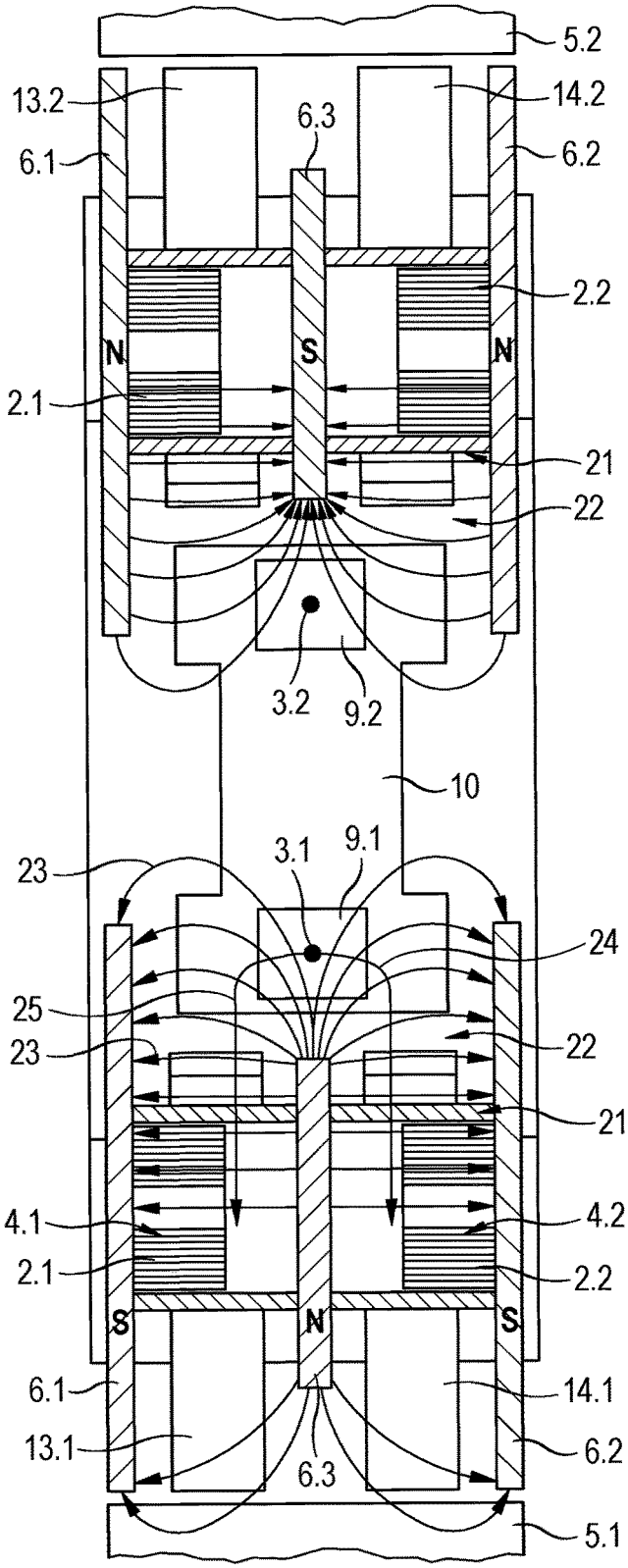
Figure 3:
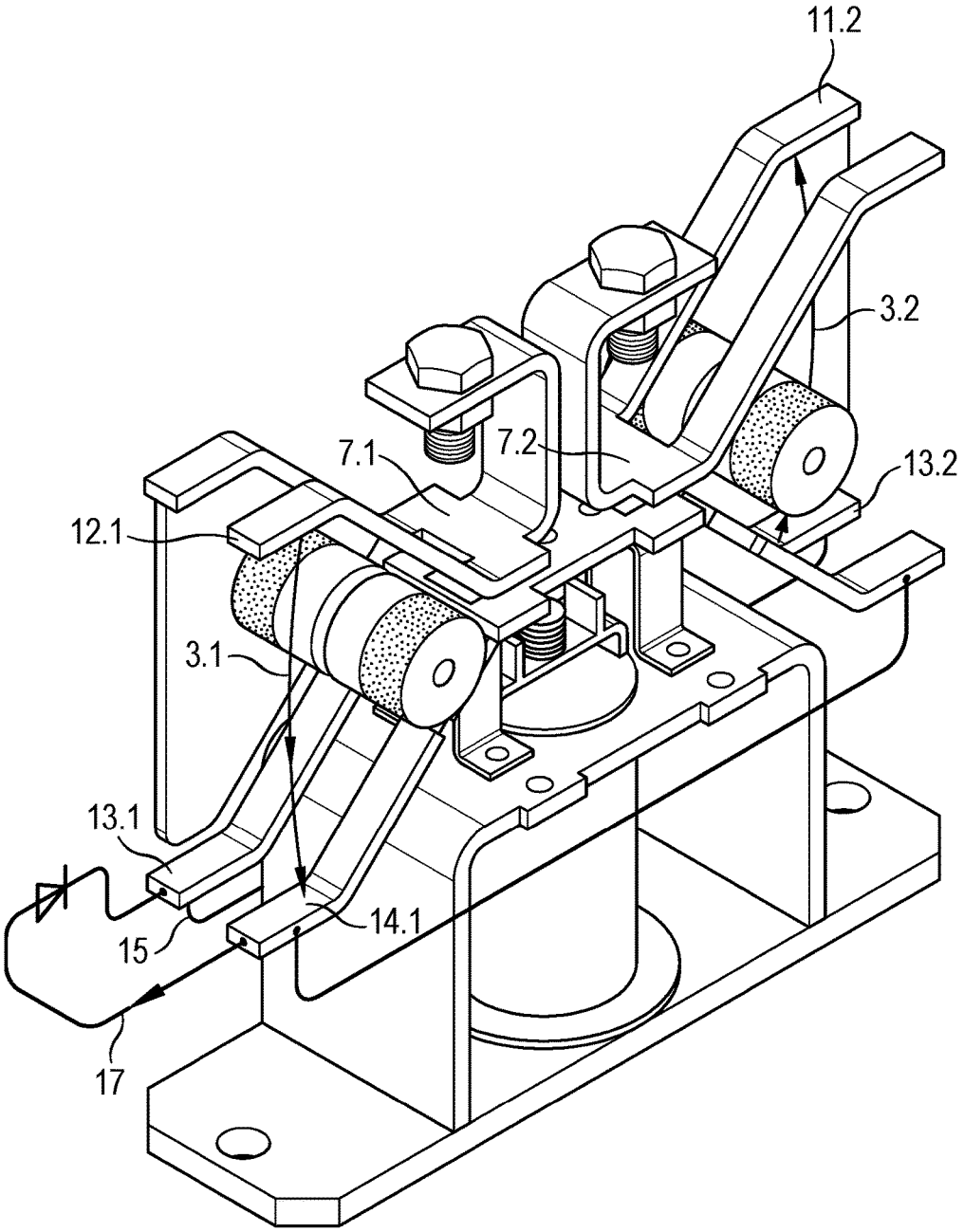
Figure 4:
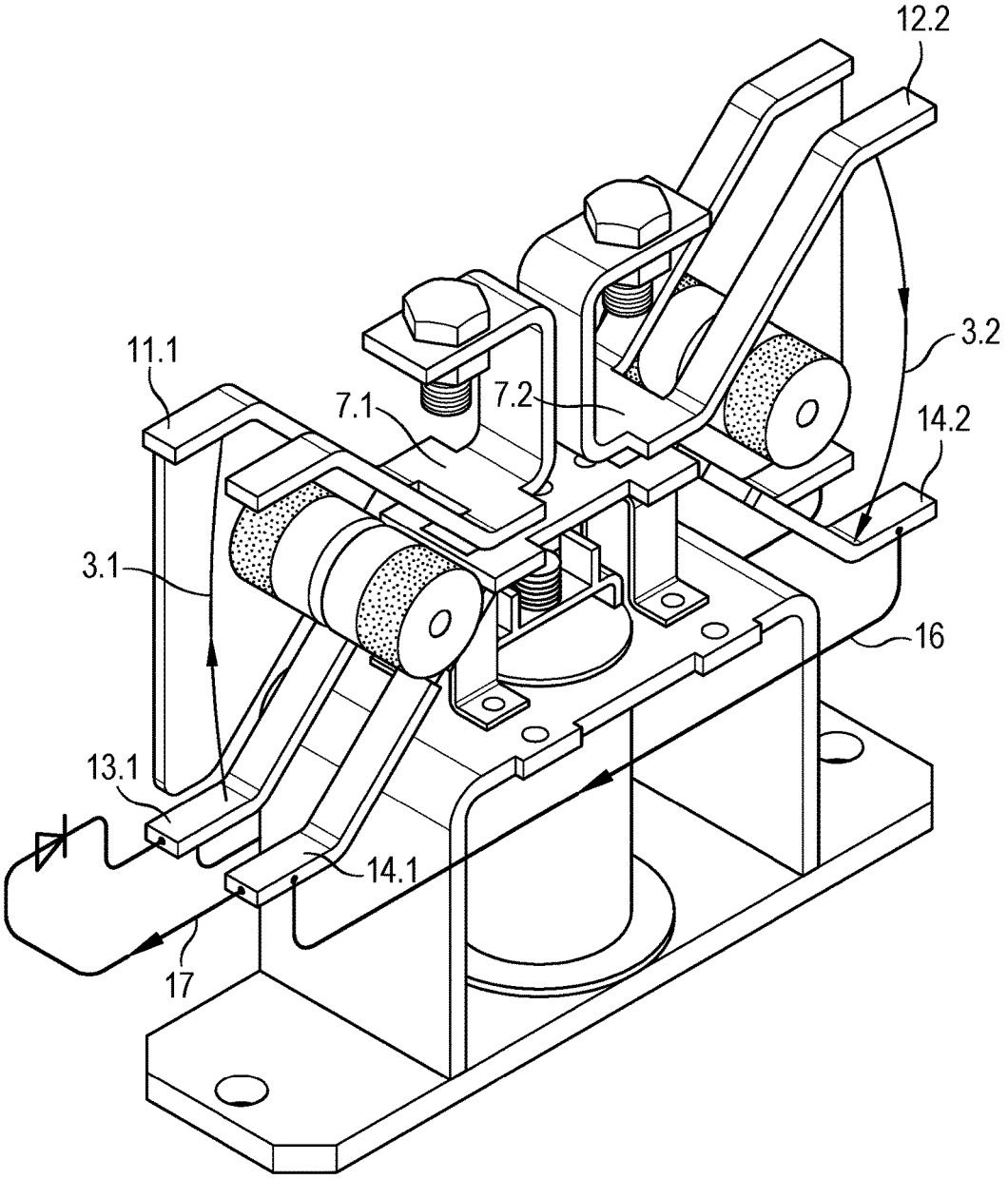
Figure 5:
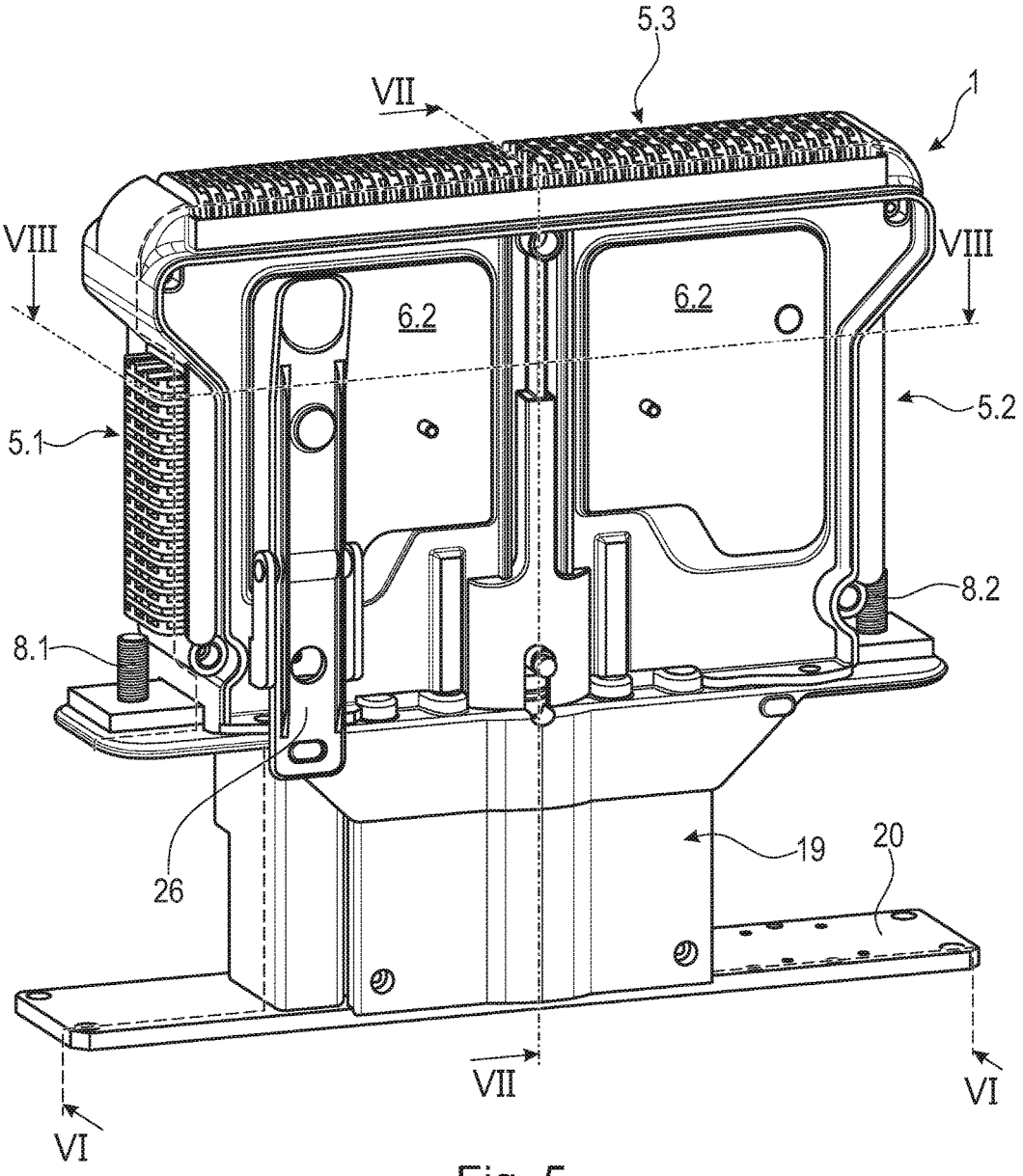
Figure 6:
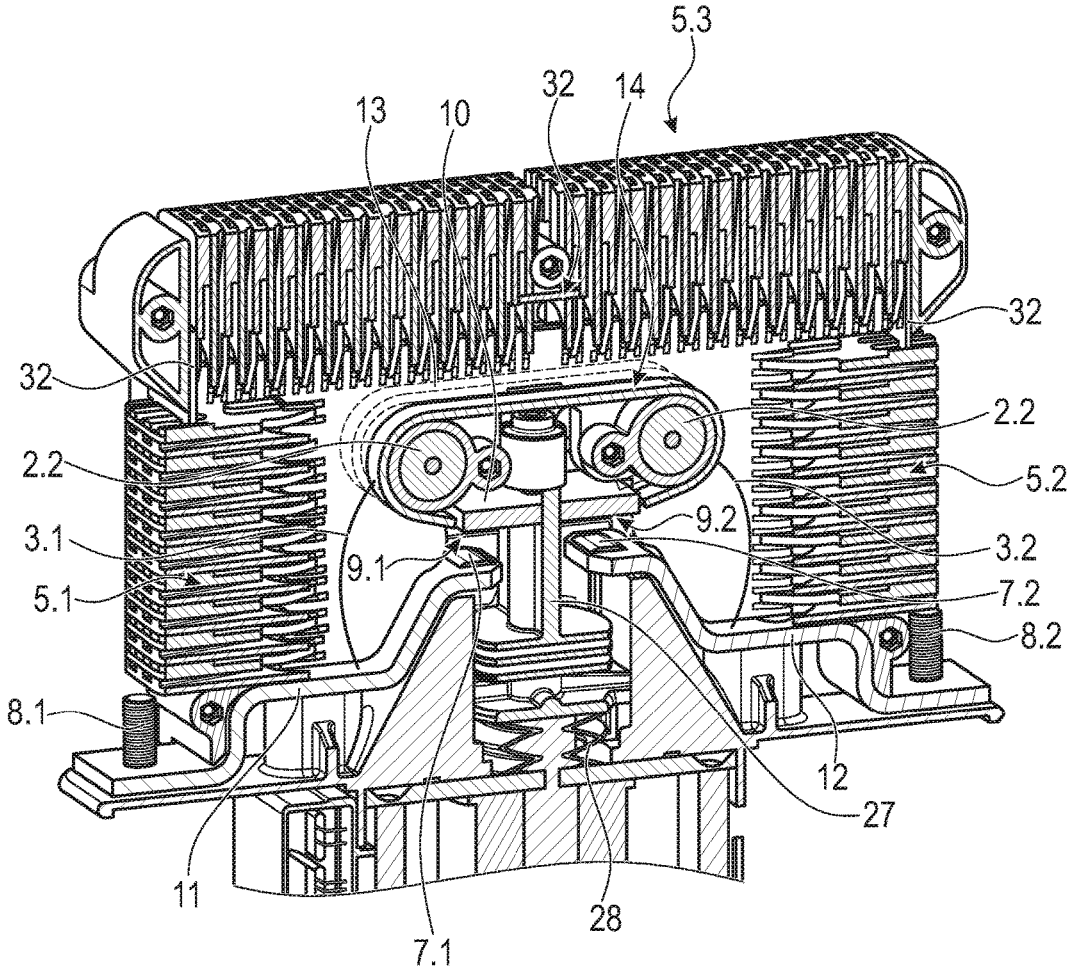
Figure 7:
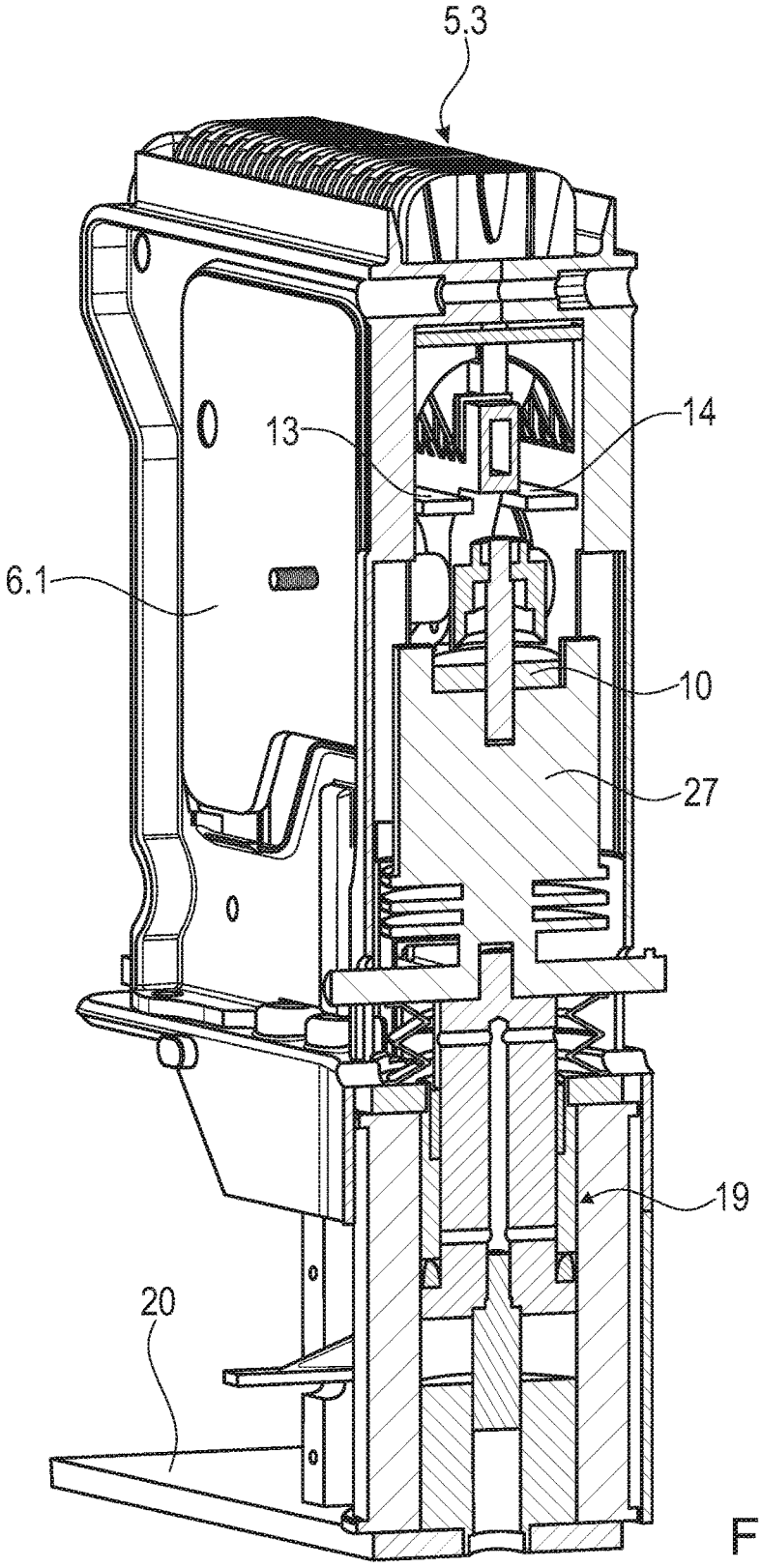
Figure 8:
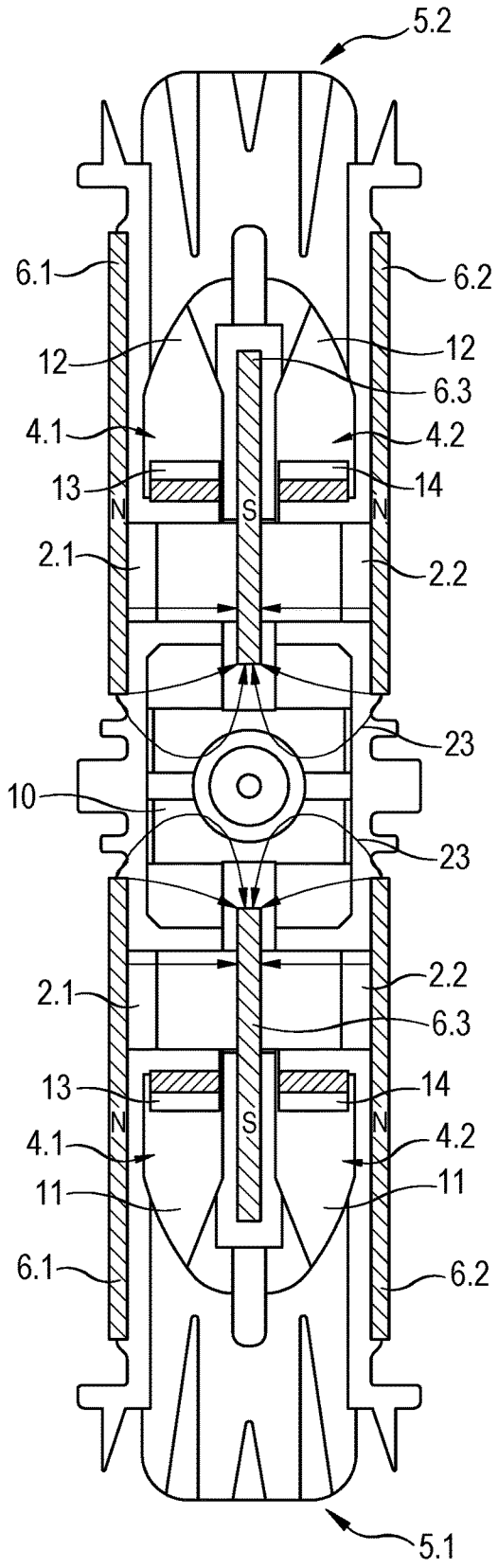
Figure 9:
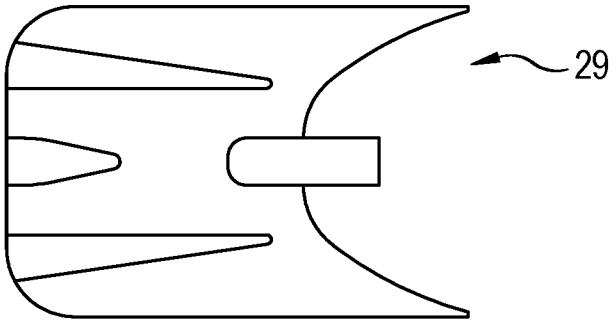
Figure 10:
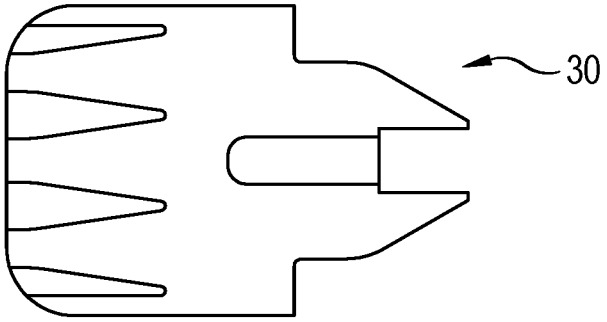

Embodiments of the present invention are explained in more detail below with reference to drawings, where:

FIG. 1: shows an oblique view of a switching device according to the invention with the casing being open according to a first embodiment, FIG. 2: shows a sectional plan view onto the switching device according to the invention of FIG. 1, FIG. 3: shows the switching device of FIGS. 1 and 2 in the view of FIG. 1 shortly after opening the contact points, FIG. 4: shows the representation of FIG. 3 with the direction of the current being reversed, FIG. 5: shows an oblique view of a switching device of the invention according to a second embodiment, FIG. 6: shows a sectional view through the switch according to the invention from FIG. 5 along the section line VI indicated in FIG. 5 (sectional lateral view), FIG. 7: shows a sectional view through the switch according to the invention from FIG. 5 along the section line VII indicated in FIG. 5 (sectional longitudinal view), FIG. 8: shows a sectional view through the switch according to the invention from FIG. 5 along the section line VIII indicated in FIG. 5 (sectional plan view), FIG. 9: shows an extinguishing element of the arc extinguishing device of the switch according to the invention from FIGS. 5 to 8, FIG. 10: shows a further extinguishing element of the arc extinguishing device of the switch according to the invention from FIGS. 5 to 8, FIG. 11: shows the two extinguishing elements from FIGS. 9 and 10 in the stacked state.

It applies to the following embodiments that like components are designated with like reference numerals. If a drawing contains reference numerals which are not explained in more detail in the accompanying figure description, then reference is made to preceding or subsequent figure descriptions.

FIG. 1 shows an oblique view of a switching device according to the invention 1. The switching device is a single-pole contactor. For reasons of clarity, the casing of the switching device as well as various other components, in part being illustrated in FIG. 2, are not shown. FIG. 2 shows a sectional plan view. The section runs through the axes of components 2.1 and 2.2 shown in FIG. 1.

Contactor 1 comprises two fixed contacts 7.1 and 7.2 which are each electrically connected to an associated terminal contact 8.1, 8.2. The two fixed contacts 7.1 and 7.2 can be electrically connected to each other by way of a contact bridge 10. Contact bridge 10 is actuated by the armature of an electromagnetic drive 19 and comprises two movable contacts 9.1, 9.2. When closing the contacts, first movable contact 9.1 comes to abut against first fixed contact 7.1. Second movable contact 9.2 contacts second fixed contact 7.2. As mentioned above, the casing of contactor 1 is not shown. In the depiction, only chassis 20 of the switching device is shown to which the electromagnetic drive is attached.

When the contacts open, a switch arc respectively develops between first fixed contact 7.1 and first movable contact 9.1 and between second fixed contact 7.2 and second movable contact 9.2.

In order to prevent that the switching device is damaged due to the formation of the switch arcs, the latter must be directed away from the contact area and be extinguished. The combination of first fixed contact 7.1 and first movable contact 9.1 is hereinafter referred to as the first contact point. The combination of second contact 7.2 and second movable contact 9.2 is referred to as the second contact point. The switching device comprises an arc blow device for each of the two contact points for blowing the switch arc away from the contact point. Each of the two arc blow devices is associated with an arc extinguishing device 5.1 and 5.2, respectively. The arc extinguishing devices are shown schematically in FIG. 2 and can in a well-known manner comprise a plurality of extinguishing plates or ceramic extinguishing elements.

The structure of the arc blow device is first explained for the first contact point consisting of first fixed contact 7.1 and first movable contact 9.1. The blow field being created by the arc blow device is in the switching device according to the invention generated solely in a permanent-magnetic manner. Electrically operated blow-out coils are not needed. Therefore, only the two permanent magnets 2.1 and 2.2 are employed. The two permanent magnets 2.1 and 2.2 are respectively disposed between the first contact point and arc extinguishing device 5.1 which is associated with the first contact point. First permanent magnet 2.1 is there in direct contact with first lateral pole plate 6.1, which is arranged on a side wall of the switch casing, not shown. Second permanent magnet 2.2 is likewise in direct contact with a second lateral pole plate 6.2 which is arranged on the oppositely disposed side of the casing and not shown in FIG. 1 for the sake of more clarity. A center pole plate 6.3 is located between the two lateral pole plates 6.1 and 6.2 and runs parallel to the two lateral pole plates 6.1, 6.2 and is also not shown in FIG. 1. A magnetic back iron is respectively disposed between the two permanent magnets and center pole plate 6.3. Both the back iron as well as the permanent magnets are cylindrical in shape. It is evident from FIG. 2 that both components are each enclosed by a protective covering 21.

The two permanent magnets 2.1 and 2.2 are oppositely poled. The south pole is respectively located on the outside on first pole plate 6.1 and on second pole plate 6.2, respectively. The common north pole is located on center pole plate 6.3. The opposite polarity has the effect that the magnetic field being established between second lateral pole plate 6.2 (at the right) and center pole plate 6.3 is oriented exactly opposite to the magnetic field that is established between first pole plate 6.1 (at the left) and center pole plate 6.3. This fact is also apparent from magnetic field lines 23 which are drawn in FIG. 2.

The pole plates define two channels between themselves, which both, starting out from the first contact point, lead to arc extinguishing device 5.1. A first channel 4.1 there exists between first lateral pole plate 6.1 and center pole plate 6.3. A second channel 4.2 exists between second lateral pole plate 6.2 and center pole plate 6.3. The two channels are each transverse to their longitudinal extension permeated by one of the two oppositely poled magnetic fields. As is clear from FIG. 2, the two lateral pole plates 6.1, 6.2 extend laterally adjacent to the contact point, where center pole plate 6.3 is slightly shorter and ends before the contact point. This gives rise to a transition area of the magnetic blow field at the contact point. Approximately at the center of fixed contact 7.1 or moveable contact 9.1, respectively, the magnetic field lines run perpendicular to the magnetic field lines of the two magnetic fields in channels 4.1 and 4.2. The magnetic field lines are in the transition area quasi fanned out over an angle of 180°. The direction of the magnetic field in channel 4.1 is thereby in the transition area reversed until it finally corresponds to the direction of the magnetic field in channel 4.2.

If first terminal contact 8.1 is now connected to the positive pole of a voltage source, then a switch arc 3.1 develops at the first contact point when the contacts opens and is by the magnetic blow field in FIG. 2 first deflected to the right and then enters into channel 4.2 between the second lateral pole plate 6.2 and center pole plate 6.3. The direction of movement of switch arc 3.1 is for this case illustrated by arrow 24. If first terminal contact 8.1 is connected to the negative pole of the voltage source, then the switch arc is first deflected in the opposite direction to the left. It then enters along the path illustrated by arrow 25 into left channel 4.1 between first lateral pole plate 6.1 and center pole plate 6.3 In both cases, the switch arc is subsequently by the magnetic blow field driven into arc extinguishing device 5.1. Center pole plate 6.3 is also at the opposite end facing arc extinguishing device 5.1 slightly shorter than the two lateral pole plates 6.1, 6.2. The magnetic blow field thereby shortly before the arc extinguishing device 5.1 also comprises a transition area which directs the switch arc to the center of arc extinguishing device 5.1. This allows for arc extinguishing device 5.1 to be kept compact.

At the second contact point being formed by second fixed contact 7.2 and second movable contact 9.2, an arc blow device is also provided which is of identical structure as the arc blow device at the first contact point. The only significant difference is that the two permanent magnets 2.1, 2.2 are oriented oppositely. At the second contact point, center pole plate 6.3 therefore marks the south pole. The two lateral pole plates 6.1 and 6.2 each form the north pole of the magnetic field. When first terminal contact 8.1 is connected to the positive pole and second terminal contact 8.2 to the negative pole of a voltage source, switch arc 3.2 developing at the second contact point is therefore first deflected to the left and then enters into the channel between left lateral pole plate 6.1 and center pole plate 6.3. With reversed voltage, switch arc 3.2 is at the second contact point deflected to the right and therefore enters the channel between right lateral pole plate is 6.2 and center pole plate 6.3.

It is evident from FIG. 1 that several so-called arc guide plates are provided to firstly direct the switch arc and to secondly stretch it on its way into the arc extinguishing device. The arrangement of the arc guide plates shall below first be explained for the first contact point. First fixed contact 7.1 has a first arc guide plate 11.1 and a second arc guide plate 12.1. Two arc guide plates are also associated with oppositely disposed first movable contact 9.1, namely third arc guide plate 13.1 and fourth arc guide plate 14.1. Third arc guide plate 13.1 and fourth arc guide plate 14.1 are not connected to moveable contact 9.1 or contact bridge 10, respectively, but firmly installed into the switching device. Gap 22 indicated in FIG. 2 therefore exists between third arc guide plate 13.1 and contact bridge 10 and between fourth arc guide plate 14.1 and contact bridge 10, respectively. First arc guide plate 11.1 together with third arc guide plate 13.1 forms a pair of arc guide plates which is associated with first channel 4.1 between first lateral pole plate 6.1 and center pole plate 6.3. Second arc guide plate 12.1 together with fourth arc guide plate 14.1 likewise forms a pair of arc guide plates which is associated with second channel 4.2 between second lateral pole plate 6.2 and center pole plate 6.3. The two arc guide plates of a pair of arc guide plates run diverge starting from the contact point, in order to stretch the switch arc on the way into the arc extinguishing device.

Corresponding arc guide plates are also provided at the second contact point, where third and fourth arc guide plate 13.1, 14.1 at the first contact point are each electrically connected to respective third and fourth arc guide plate 13.2, 14.2 at the second contact point. This means that third arc guide plate 13.1 at the first contact point is via an electrical connection 15 electrically connected to third arc guide plate 13.2 at the second contact point. Likewise, fourth arc guide plate 14.1 at the first contact point is via an electrical connection 16 electrically connected to fourth arc guide plate 14.2 at the second contact point. There is additionally an electrical connection 17 between third arc guide plate 13.1 and fourth arc guide plate 14.1 at the first contact point in which a diode 18 is provided permitting only one direction of current. It should be noted that the diode is necessary only in the event that the contactor is used for AC-applications. Second fixed contact 7.2 is connected to the two arc guide plates 11.2 and 12.2. Arc guide plate 11.2 there at the second contact point forms the first arc guide plate. Arc guide plate 12.2 forms the second arc guide plate.

In the following, the mode of operation of the arc guide plates and the respective electrical connection lines are explained in more detail. When first terminal contact 8.1 is connected to the positive pole and second terminal contact 8.2 to the negative pole of a voltage source, switch arc 3.1 developing at the first contact point enters into second channel 4.2 between second lateral pole plate 6.2 and center pole plate 6.3. At the time switch arc 3.1 develops, the latter exists between first fixed contact 7.1 and first movable contact 9.1 which is arranged on contact bridge 10. In order to be able to enter channel 4.2, the switch arc must spark over from contact bridge 10 to fourth arc guide plate 14.1. The current there flows from first fixed contact 7.1 via second arc guide plate 12.1, first switch arc 3.1, fourth arc guide plate 14.1, electrical connection line 17, third arc guide plate 13.1, electrical connection line 15, third arc guide plate 13.2 at the second contact point, second switch arc 3.2 and first arc guide plate 11.2 at the second contact point to second fixed contact 7.2. This case is illustrated in FIG. 3.

With reverse voltage applied, the case shown in FIG. 4 arises. The current there flows from second fixed contact 7.2 via second arc guide plate 12.2 at the second contact point, second switch arc 3.2, fourth arc guide plate 14.2, electrical connection line 16, third arc guide plate 14.1, electrical connection line 17, third arc guide plate 13.1, first switch arc 3.1 the first arc guide plate 11.1 at the first contact point to first fixed contact 7.1. In both cases, first switch arc 3.1 and second switch arc 3.2 are stretched accordingly by the arc guide plates and ultimately extinguished in the associated arc extinguishing device.

By using diode 18 in electrical connecting line 17 between third arc guide plate 13.1 and fourth arc guide plate 14.1 at the first contact point, the switching device according to the invention is also suitable for AC operation. If switch arcs 3.1 and 3.2 develop during the positive half-wave, then the state shown in FIG. 3 is first given. At a mains frequency of 50 Hz, the duration of the positive half-wave is 10 milliseconds. There is therefore sufficient time for the switch arc to spark over from the contact bridge onto the respective arc guide plate. The transition to the negative half-wave is simply prevented by the use of diode 18. The direction of the current can no longer reverse. Re-solidification occurs, whereby the switch arc can in the negative half-wave not re-ignite. The same applies to the case where the switch arc develops during the negative half-wave. In this case, the situation shown in FIG. 4 first arises. Here as well re-solidification again occurs and re-ignition of the arc is prevented.

FIGS. 5 to 8 show a second embodiment of a switching device 1 according to the invention. The set-up basically corresponds to the set-up of the switching device of FIGS. 1 to 4. Same components are designated by same reference numerals. The differences from the first embodiment in FIGS. 1 to 4 shall essentially be described below.

As shown in FIG. 6, contact bridge 10 is with the two movable contacts 9.1 and 9.2 in contrast to the first embodiment disposed above the two fixed contacts 7.1 and 7.2. Electromagnetic drive 19 is like in the first embodiment located below the two contact points. This has the advantage that the upper part of the casing can be completely removed for maintenance purposes, whereby free access to the contacts is made possible. The upper casing part is locked by way of latch 26 shown in FIG. 5.

The switching device according to the second embodiment also comprises two contact points. First contact point 7.1/9.1 is associated with a first arc blow device, second contact point 7.2/9.2 is associated with a second arc blow device. The first arc blow device is shown in FIG. 8 in the lower half of the image, the second arc blow device is in FIG. 8 located in the upper half of the image. The first arc blow device and the second arc blow device are essentially configured in mirror symmetry to each other. The magnetic polarity of pole plates 6.1, 6.2 and 6.3 of the first arc blow device in this embodiment therefore matches the magnetic polarity of pole plates 6.1, 6.2 and 6.3 of the second arc blow device.

Figure 11:
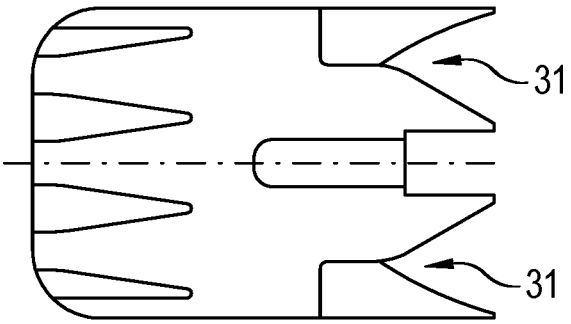

The arc extinguishing device of switching device 1 comprises a first arc extinguishing device 5.1 and a second arc extinguishing device 5.2 on opposite sides of the casing. First arc extinguishing device 5.1 is associated with first contact point 7.1/9.1. First channel 4.1 and second channel 4.2 of the first arc blow device being associated with the first contact point each lead to first arc extinguishing device 5.1. Second arc extinguishing device 5.2 is associated with second contact point 7.2/9.2. First channel 4.1 and second channel 4.2 of the second arc blow device being associated with the second contact point each lead to second arc extinguishing device 5.2. Third arc extinguishing device 5.3 is further disposed on an upper side of the casing, where the first and the second channels of the first and the second arc blow devices also lead to third arc extinguishing device 5.3. The extinguishing potential is if necessary increased by the third arc extinguishing device. Parts of the casing being located between the arc extinguishing device can by suitable copper plates 32 be protected from the arc. All three arc extinguishing devices 5.1, 5.2, and 5.3 each comprise several extinguishing elements 29 and 30, which are alternately stacked. The extinguishing elements are made of ceramic. At that end facing the contact point, they each comprise at least two wedge-shaped flanks, where the wedge-shaped flanks of a first extinguishing element 29 shown in FIG. 9 complement the wedge-shaped flanks of a subsequent second extinguishing element 30 to form two V-shaped grooves 31 which are each associated with one of the two channels 4.1 and 4.2. Second extinguishing element 30 is shown in FIG. 10, the resulting V-shaped grooves are shown in FIG. 11. Depending on the direction of the current, the arc is blown either through first channel 4.1 or through second channel 4.2 of the respective arc blow device into one of the two V-shaped grooves.

First fixed contact 7.1 is associated with a first arc guide plate 11 and second fixed contact 7.2 is associated with a second arc guide 12. First arc guide plate 11 and second arc guide plate 12 extend between respective fixed contact 7.1 or 7.2 and respectively associated arc extinguishing device 5.1 or 5.2. They each connect fixed contact 7.1 or 7.2, respectively, with associated terminal contact 8.1 or 8.2, respectively. First arc guide plate 11 and second arc guide plate 12 are disposed below respective center pole plate 6.3 and they each extend in width both over first channel 4.1 as well as over parallel second channel 4.2 of the associated arc blow device. Furthermore, a third arc guide plate 13 and a fourth arc guide plate 14 are provided. Third arc guide plate 13 and fourth arc guide plate 14 each extend in an arcuate manner from first movable contact 9.1 to second movable contact 9.2, so that third arc guide plate 13 and fourth arc guide plate 14 together with contact bridge 10 each form a nearly closed loop. As shown in FIG. 6, center pole plates 6.3 of the first and the second arc blow device are respectively disposed between third arc guide plate 13 and fourth arc guide plate 14. Third arc guide plate 13 is in the representation of FIG. 6 located behind the two center pole plates 6.3 and is therefore in this figure shown in dashed lines.

The ends of third arc guide plate 13 and fourth arc guide plate 14 are each slightly spaced from the ends of contact bridge 10 so that contact bridge 10 can be moved relative to the third and the fourth arc guide plate. A foot of the switch arc sparks over from the contact bridge onto the third or the fourth arc guide plate, respectively, when the arc is blown out from the contact point. The corners of the contact bridge are preferably rounded in order to increase service life.

First blow magnet 2.1 of the first arc blow device and first blow magnet 2.1 of the second arc blow device are disposed within the loop being formed by third arc guide plate 13 and contact bridge 10, where second blow magnet 2.2 of the first arc blow device and second blow magnet 2.2 of the second arc blow device are disposed within the loop being formed by fourth arc guide plate 14 and contact bridge 10. The blow magnets are thereby in a simple manner shielded from the arc. A protective covering for the blow magnets made of ceramic or the like is not required.

Center pole plates 6.3 of the first and the second arc blow device are sheathed in an electrically insulating manner. Contact bridge 10 is disposed on a contact carrier 27 made of electrically insulating material. As shown in FIG. 7, contact carrier 27 extends between the first contact point and the second contact point across the clear width of the casing of the switching device. The contact carrier plunges on both sides into corresponding grooves of the housing such that a barrier in the fashion of a labyrinth seal is formed for the plasma created by the arc. A bellows 28 is further disposed below contact carrier 27 to prevent a ground fault which would otherwise occur due to the plasma created by the arc in the event of a flash-arc onto the yoke plate of the drive of the switching device when correspondingly high loads are switched.

In the second embodiment shown in FIGS. 5 to 8, the two switch arcs 3.1 and 3.2 developing at contact points 7.1/9.1 and 7.2/9.2 are in the representation of FIG. 8 depending on the direction of the current first deflected either both to the right or both to the left, then blown into respective arc extinguishing device 5.1 or 5.2, and subsequently also into third arc extinguishing device 5.3. Depending on the direction of the current, switch arcs 3.1 and 3.2 are therefore driven through either channels 4.1 or, as is shown in FIG. 6, through channels 4.2 into the arc extinguishing devices.

The invention claimed is:

1. A switching device with at least one contact point and an arc blow device associated with said contact point, where said arc blow device comprises at least one blow magnet for generating a magnetic blow field, where said blow field is of such nature that a switch arc developing when said contact point opens is blown out from said contact point, wherein said blow field comprises a first magnetic field area and a second magnetic field area arranged adjacent to said first magnetic field area, where magnetic field lines of said first magnetic field area are oriented in opposite direction to magnetic field lines of said second magnetic field area, and where said blow field further comprises a first transition area which connects said first magnetic field area and said second magnetic field area with each other, where an orientation of said magnetic field lines in said first transition area, each starting out from said first magnetic field area and said second magnetic field area, aligns toward said contact point so that said switch arc within said first transition area is in dependence of a direction of a current, starting out from said contact point, directed either into said first magnetic field area or into said second magnetic field area and there in both cases blown in the same direction away from said contact point, wherein said arc blow device comprises a first lateral pole plate, a second lateral pole plate and an interposed center pole plate, where said first magnetic field area is given between said first lateral pole plate and said center pole plate, and where said second magnetic field area is given between said second lateral pole plate and said center pole plate, wherein said switching device further comprises an arc extinguishing device which is arranged such that said switch arc is blown through said arc blow device into said arc extinguishing device, irrespective of the direction of the current, wherein said center pole plate at least at one first end facing said contact point is shorter than said two lateral pole plates, wherein the first transition area is adjacent to the first end and between the first and second lateral pole plates, and wherein said center pole plate is at a second end disposed opposite to its first end also shorter than said two lateral pole plates, wherein a second transition area is located adjacent the second end between the first and second lateral pole plates such that the center pole plate is located between the first and second transition areas, and wherein said switch arc after passing through either the first or second magnetic field area and entering the second transition area is directed away from the lateral pole plate corresponding to the magnetic field area that the arc passed through and toward a center of the second transition area in order to be blown into a center of the arc extinguish device.

2. The switching device according to claim 1, wherein said first magnetic field area is associated with a first channel and said second magnetic field area with a second channel, where said first channel and said second channel extend in parallel and are arranged adjacently, and where said first channel is transverse to its longitudinal extension permeated by the magnetic field lines of said first magnetic field area, and said second channel is transverse to its longitudinal extension permeated by the magnetic field lines of said second magnetic field area.

3. The switching device according to claim 1, wherein said first lateral pole plate is associated with at least one first blow magnet, and said second lateral pole plate with at least one second blow magnet, where said first blow magnet and said second blow magnet are poled oppositely, and where said blow magnets are permanent magnets.

4. The switching device according to claim 1, wherein said two lateral pole plates extend laterally adjacent to said contact point, so that said contact point is located between a first end of said first lateral pole plate and a first end of said second lateral pole plate.

5. A switching device with at least one contact point and an arc blow device associated with said contact point, where said arc blow device comprises at least one blow magnet for generating a magnetic blow field, where said blow field is of such nature that a switch arc developing when said contact point opens is blown out from said contact point, wherein said blow field comprises a first magnetic field area and a second magnetic field area arranged adjacent to said first magnetic field area, where magnetic field lines of said first magnetic field area are oriented in opposite direction to magnetic field lines of said second magnetic field area, and where said blow field further comprises a transition area which connects said first magnetic field area and said second magnetic field area with each other, where an orientation of said magnetic field lines in said transition area, each starting out from said first magnetic field area and said second magnetic field area, aligns toward said contact point so that said switch arc within said transition area is in dependence of a direction of a current, starting out from said contact point, directed either into said first magnetic field area or into said second magnetic field area and there in both cases blown in the same direction away from said contact point, wherein said switching device comprises a first contact point and a second contact point, where said first contact point is associated with a first arc blow device and said second contact point with a second arc blow device, where said first contact point comprises a first fixed contact and a first moveable contact, where said second contact point comprises a second fixed contact and a second movable contact, where said first movable contact and said second movable contact are arranged at oppositely disposed ends of a common contact bridge, where said first fixed contact is associated with at least one first arc guide plate and said second fixed contact with at least one second arc guide plate, where said first arc guide plate and said second arc guide plate extend between said respective fixed contact and said arc extinguishing device and are conductively connected to said respective fixed contact, where furthermore a third arc guide plate and a fourth arc guide plate are provided, where said third arc guide plate and said fourth arc guide plate each extend in an arcuate manner from said first movable contact to said second movable contact, so that said third arc guide plate and said fourth arc guide plate together with said contact bridge each form an almost closed loop, and where said center pole plates of said first and said second arc blow device are each arranged between said third and said fourth arc guide plate.

6. The switching device according to claim 5, wherein said first blow magnet of said first arc blow device and said first blow magnet of said second arc blow device are disposed within the loop being formed by said third arc guide plate and said contact bridge, where said second blow magnet of said first arc blow device and said second blow magnet of said second arc blow device are disposed within the loop being formed by said fourth arc guide plate and said contact bridge.

7. The switching device according to claim 5, wherein said center pole plates of said first and said second arc blow device are sheathed in an electrically insulating manner.

8. The switching device according to claim 5, wherein said arc extinguishing device comprises a first arc extinguishing device and a second arc extinguishing device, where said first and said second arc extinguishing devices are arranged at oppositely disposed sides of a casing of said switching device such that said first channel and said second channel of said first arc blow device lead to said first arc extinguishing device, where said first channel and said second channel of said second arc blow device lead to said second arc extinguishing device.

9. The switching device according to claim 8, wherein a third arc extinguishing device is further disposed on an upper side of said casing connecting the two oppositely disposed sides of said casing such that said first and said second channels of said first and said second arc blow devices also lead to said third arc extinguishing device.

10. The switching device according to claim 8, wherein said arc extinguishing device can be completely removed, possibly together with said two arc blow devices.

11. The switching device according to claim 5, wherein said contact bridge is arranged on a contact carrier made of electrically insulating material, where said contact carrier extends between said first contact point and said second contact point across the clear width of said casing of said switching device.

* * * * *